US011210990B2

(12) United States Patent
Knez et al.

(10) Patent No.: US 11,210,990 B2
(45) Date of Patent: Dec. 28, 2021

(54) FOVEATED DISPLAY

(71) Applicant: Apple Inc., Cupertino, CA (US)

(72) Inventors: Ivan Knez, San Jose, CA (US); Cheuk Chi Lo, San Francisco, CA (US); Akira Matsudaira, San Francisco, CA (US); Chun-Yao Huang, Cupertino, CA (US); Giovanni Carbone, Palo Alto, CA (US); Paolo Sacchetto, Cupertino, CA (US); Chaohao Wang, Cupertino, CA (US); Sheng Zhang, San Francisco, CA (US); Adam Adjiwibawa, San Jose, CA (US)

(73) Assignee: Apple Inc., Cupertino, CA (US)

( * ) Notice: Subject to any disclaimer, the term of this patent is extended or adjusted under 35 U.S.C. 154(b) by 32 days.

(21) Appl. No.: 16/325,260

(22) PCT Filed: Aug. 15, 2017

(86) PCT No.: PCT/US2017/047023

§ 371 (c)(1),
(2) Date: Feb. 13, 2019

(87) PCT Pub. No.: WO2018/035166

PCT Pub. Date: Feb. 22, 2018

(65) Prior Publication Data

US 2019/0180672 A1 Jun. 13, 2019

Related U.S. Application Data

(60) Provisional application No. 62/375,633, filed on Aug. 16, 2016.

(51) Int. Cl.
*G09G 3/20* (2006.01)
*G09G 5/36* (2006.01)
(Continued)

(52) U.S. Cl.
CPC ..... *G09G 3/2092* (2013.01); *G09G 5/363* (2013.01); *G09G 5/391* (2013.01); *G09G 5/397* (2013.01);
(Continued)

(58) Field of Classification Search
CPC ..... G09G 3/2092; G09G 5/363; G09G 5/391; G09G 5/397; G09G 2370/08;
(Continued)

(56) References Cited

U.S. PATENT DOCUMENTS 6,166,715 A * 12/2000 Chang ..... G09G 3/3688 345/100
2003/0184561 A1* 10/2003 Vorst ..... G09B 9/301 345/619
(Continued)

OTHER PUBLICATIONS

Blanke et al., Active Visualization in a Multidisplay Immersive Environment, Eighth Eurographics Workshop on Virtua Environments, 2002, 10 pages.
(Continued)

*Primary Examiner* — Jonathan A Boyd
(74) *Attorney, Agent, or Firm* — Treyz Law Group, P.C.; Jason Tsai

(57) ABSTRACT

An electronic device may have a display and a gaze tracking system. The electronic device may display images on the display that have a higher resolution in a portion of the display that overlaps a gaze location than other portions of the display. Timing controller circuitry and column driver circuitry may include interpolation and filter circuitry. The interpolation and filter circuitry may be used to perform nearest neighbor interpolation and two-dimensional spatial filtering on low resolution image data. Display driver circuitry may be configured to load higher resolution data into selected portions of a display. The display driver circuitry may include low and high resolution image data buffers and
(Continued)

configurable row driver circuitry. Block enable transistors may be included in a display to allow selected blocks of pixels to be loaded with high resolution image data.

16 Claims, 11 Drawing Sheets

(51) Int. Cl.
*G09G 5/391* (2006.01)
*G09G 5/397* (2006.01)

(52) U.S. Cl.
CPC ..... *G09G 2320/0261* (2013.01); *G09G 2340/0407* (2013.01); *G09G 2340/0414* (2013.01); *G09G 2340/0421* (2013.01); *G09G 2350/00* (2013.01); *G09G 2354/00* (2013.01); *G09G 2360/08* (2013.01); *G09G 2370/08* (2013.01)

(58) Field of Classification Search
CPC ..... G09G 2340/0407; G09G 2354/00; G09G 2320/0261; G09G 2340/0414; G09G 2340/0421; G09G 2350/00; G09G 2360/08
See application file for complete search history.

(56) References Cited

U.S. PATENT DOCUMENTS

2005/0099540 A1* 5/2005 Elliott ..... G06T 3/4023 348/458
2008/0129760 A1* 6/2008 Phan ..... G09G 3/342 345/690
2009/0225105 A1* 9/2009 Park ..... G09G 3/3688 345/690
2011/0187755 A1 8/2011 Choi et al.
2013/0286003 A1* 10/2013 Park ..... G09G 3/3685 345/214
2016/0267716 A1* 9/2016 Patel ..... G09G 5/373

OTHER PUBLICATIONS

Blanke et al., Active visualization in a multidisplay immersive environment, Computers & Graphics 27, 2003, pp. 681-691.
Sanford et al., Technology and Design of an Active Matrix OLED on Crystalline Silicon Direct View Display for a WristWatch Computer, RC 22121 (99108) Electrical Engineering, Jul. 19, 2001, 13 pages.

* cited by examiner

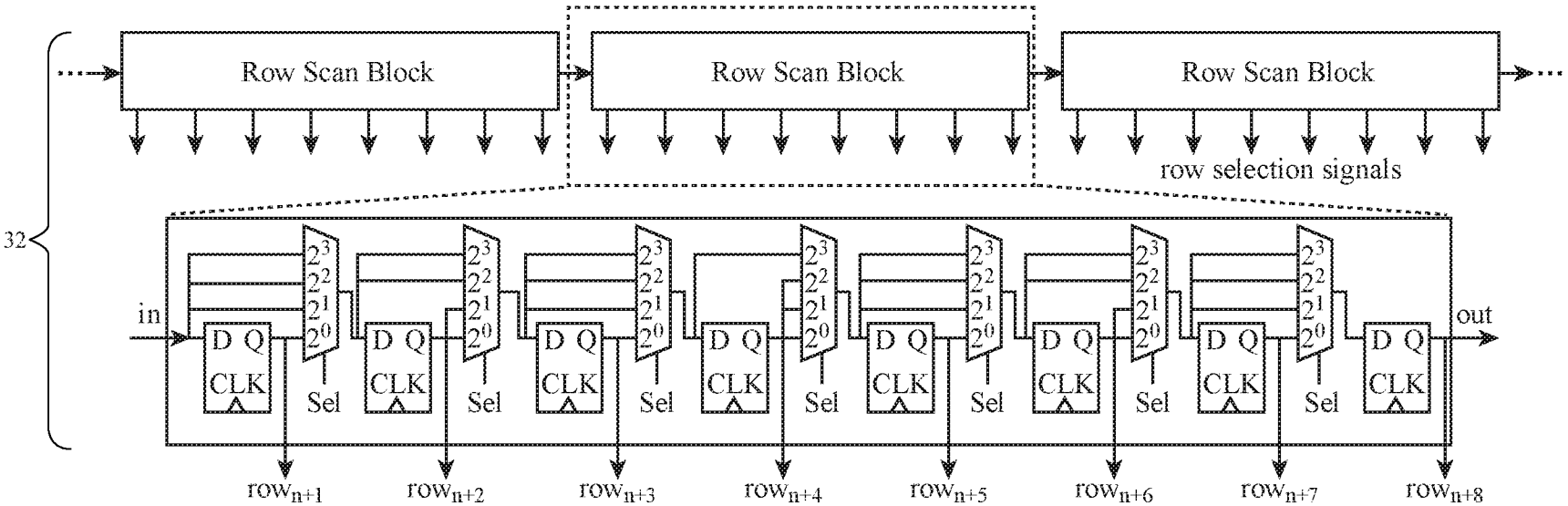
*FIG. 10*
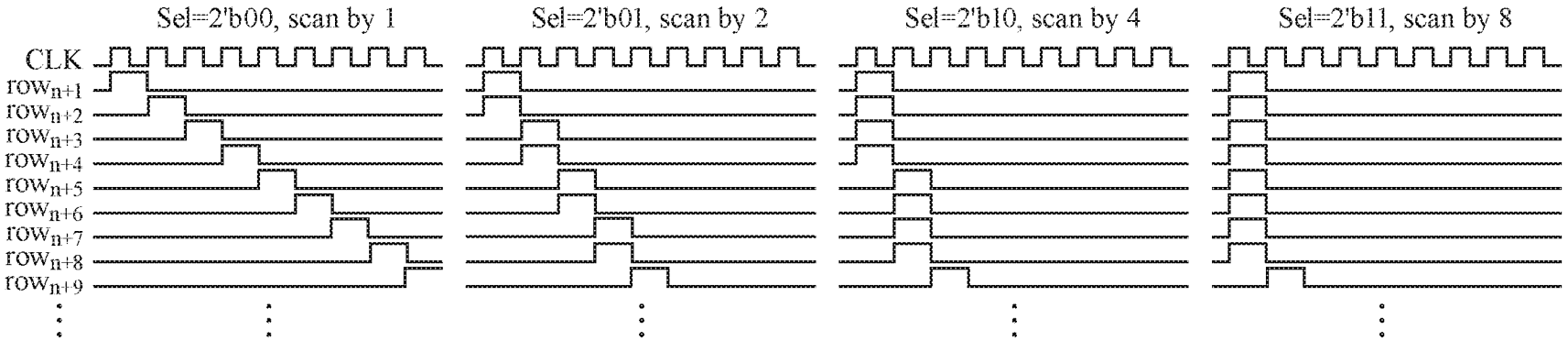
*FIG. 11* *FIG. 12* *FIG. 13* *FIG. 14*

FOVEATED DISPLAY

This application claims priority to provisional patent application No. 62/375,633, filed on Aug. 16, 2016, which is hereby incorporated by reference herein in its entirety.

BACKGROUND

This relates generally to displays, and, more particularly, to foveated displays.

Electronic devices often include displays. Particularly when high resolution images are being displayed for a viewer, it may be burdensome to display images at full resolution across an entire display. Foveation techniques involve displaying only critical portions of an image at full resolution and can help reduce the burdens on a display system. If care is not taken, however, display driver circuitry will be overly complex, bandwidth requirements will be excessive, and display quality will not be satisfactory.

SUMMARY

An electronic device may have a display and a gaze tracking system. The electronic device may display images on the display that have a higher resolution in a portion of the display that overlaps a gaze location than other portions of the display. The gaze location may be updated in real time based on information from the gaze tracking system. As a user views different portions of the display, a graphics processing unit in the device may be used to dynamically produce high resolution image data in an area that overlaps the updated gaze location.

Timing controller circuitry and column driver circuitry may be used to display images on an array of pixels in the display. The timing controller circuitry may receive image data from the graphics processing unit and may provide image data to the column driver circuitry. The timing controller circuitry and column driver circuitry may include interpolation and filter circuitry. The interpolation and filter circuitry may be used to perform interpolation operations such as nearest neighbor interpolation and may be used to apply two-dimensional spatial filters to low resolution image data.

Display driver circuitry may be configured to load high resolution data from the graphics processing unit into selected portions of a display. The display driver circuitry may include low and high resolution image data buffers, configurable column driver circuitry, and configurable row driver circuitry.

Display driver circuitry may enable and disable data loading to blocks of pixels in the pixel array. Block enable transistors may be included in the pixels. The display driver circuitry may control the block enable transistors to allow selected blocks of pixels to be loaded with high resolution image data.

BRIEF DESCRIPTION OF THE DRAWINGS

FIG. 10 is a diagram of illustrative reconfigurable gate driver circuitry for a display in accordance with an embodiment.

FIGS. 11, 12, 13, and 14 are timing diagrams showing illustrative gate line signals that may be generated by the gate driver circuitry of FIG. 15 in different operating modes in accordance with an embodiment.

DETAILED DESCRIPTION

Figure 1:
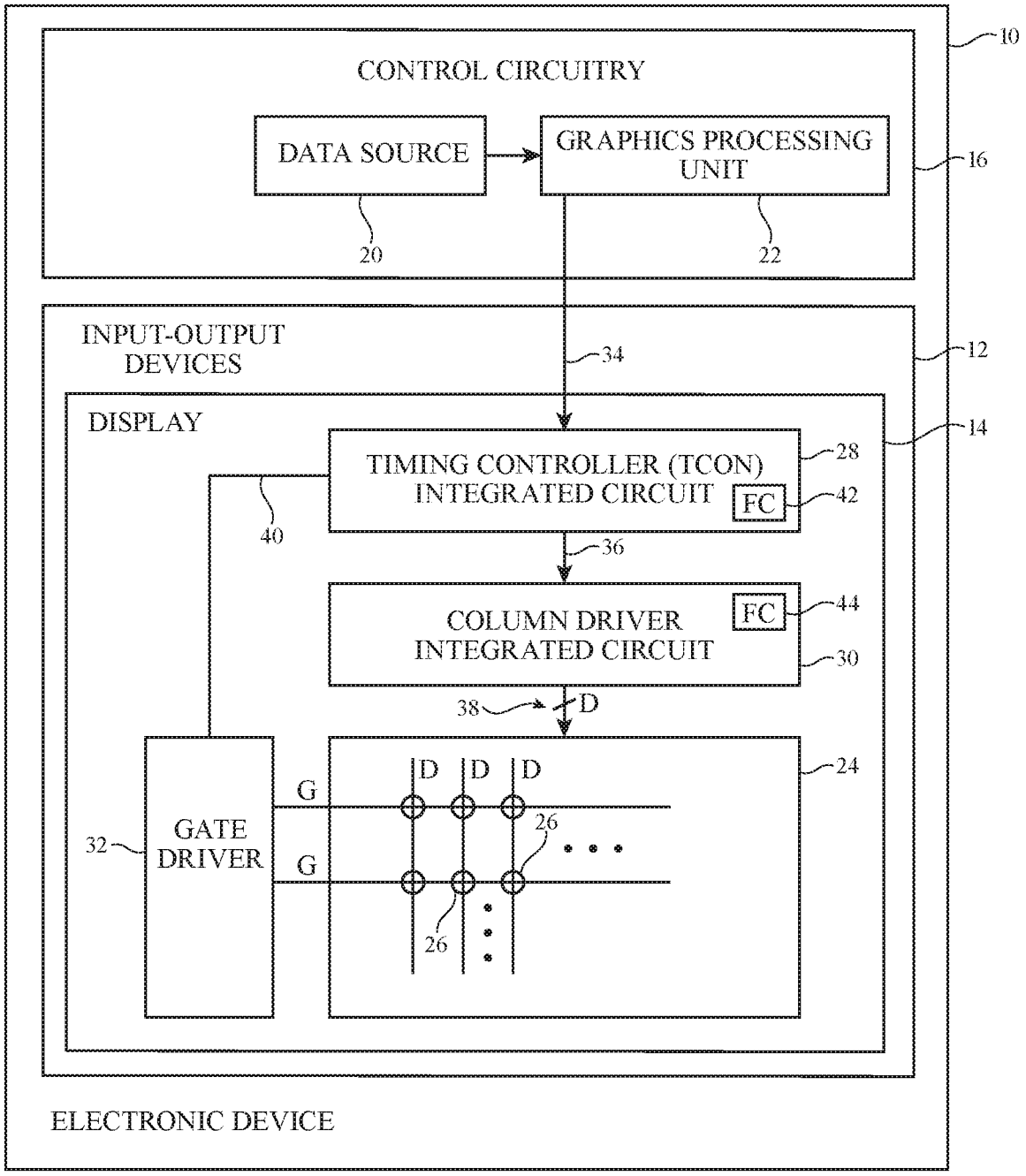
FIG. 1 is a diagram of an illustrative electronic device having a display in accordance with an embodiment.

An illustrative electronic device with a display is shown in FIG. 1. As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may mounted in a housing for a computer, cellular telephone or other device, may be mounted within a head-mounted display chassis (e.g., device 10 may be configured to be worn on the head of a user), may be mounted on a wall or on a stand, may be a projector, or may be any other suitable type of display.

Control circuitry 16 may be used to run software on device 10 such as operating system code and applications. During operation of device 10, the software running on control circuitry 16 may display images on display 14. For example, data source 20 may supply graphics processing unit 22 with information on three-dimensional images to be displayed on display 14. Data source 20 may, for example, be part of a computer game or other application running on control circuitry 16 that supplies output to graphics processing unit 22 in the form of three-dimensional coordinates. Graphics processing unit 22 may perform rendering operations that map the three-dimensional coordinates from data source 20 onto a two-dimensional plane for presentation as two-dimensional images on display 14. Other types of image content may be display, if desired.

Display 14 may be an organic light-emitting diode display, a liquid crystal display, a liquid crystal-on-silicon display, a projector display such as a microelectromechanical systems (MEMs) display (sometimes referred to as a digital light processing display), may be a display formed form an array of micro-light-emitting diodes (e.g., light-emitting diodes formed from discrete crystalline semiconductor dies), or other suitable type of display.

As shown in FIG. 1, display 14 may have a pixel array such as pixel array 24. Pixel array 24 may have rows and columns of pixels 26. Images may be displayed on pixel array 24 using display driver circuitry such as timing controller integrated circuit 28, column driver integrated circuit 30, and gate driver circuitry 32. Circuitry 28 and 30 may be formed from separated integrated circuits or may be part of a single integrated circuit. Circuitry 32 may be implemented as thin-film transistor circuitry or as one or more integrated circuits. If desired, circuitry 32 and/or other display driver circuitry such as circuitry 28 and 30 may be incorporated onto a common substrate with pixel array 24 (e.g., a common semiconductor substrate such as a silicon substrate in a liquid crystal on silicon display, a common glass substrate in a liquid crystal display, etc.). During operation, column driver circuitry 30 may provide pixel array 24 with data over data lines D in data path 38 while circuitry 28 or 30 supplies clock signals and other control signals to gate driver circuitry 32 over a path such as path 40 that direct gate driver circuitry 32 to produce corresponding gate line signals (sometimes referred to as horizontal control signals, scan signals, emission signals, gate signals, etc.) for pixel array 24 on gate lines G. There may be one or more gate lines G in each row of pixels 26. A data line D may be associated with each column of pixels 26.

Timing controller integrated circuit 28 and/or column driver integrated circuit 30 may include interpolation and filtering circuitry such as circuitry 42 in circuitry 28 and/or circuitry 44 in circuitry 30. This circuitry may ease the processing burden on graphics processing unit 22 and may thereby help to reduce the bandwidth requirements for the data links in device 10 such as links 34 and/or 36. In particular, the inclusion of interpolation and filtering circuitry in the display driver circuitry of display 14 may allow graphics processing unit 22 to only render portions of a displayed image at full resolution. Other portions of the image may be rendered at low and/or intermediate level(s) of resolution. Because graphics processing unit 22 need not render entire images at full resolution, the bandwidth involved in transmitting data between graphics processing unit 22 and circuit 28 (e.g., over a serial link) may be reduced.

Figure 2:
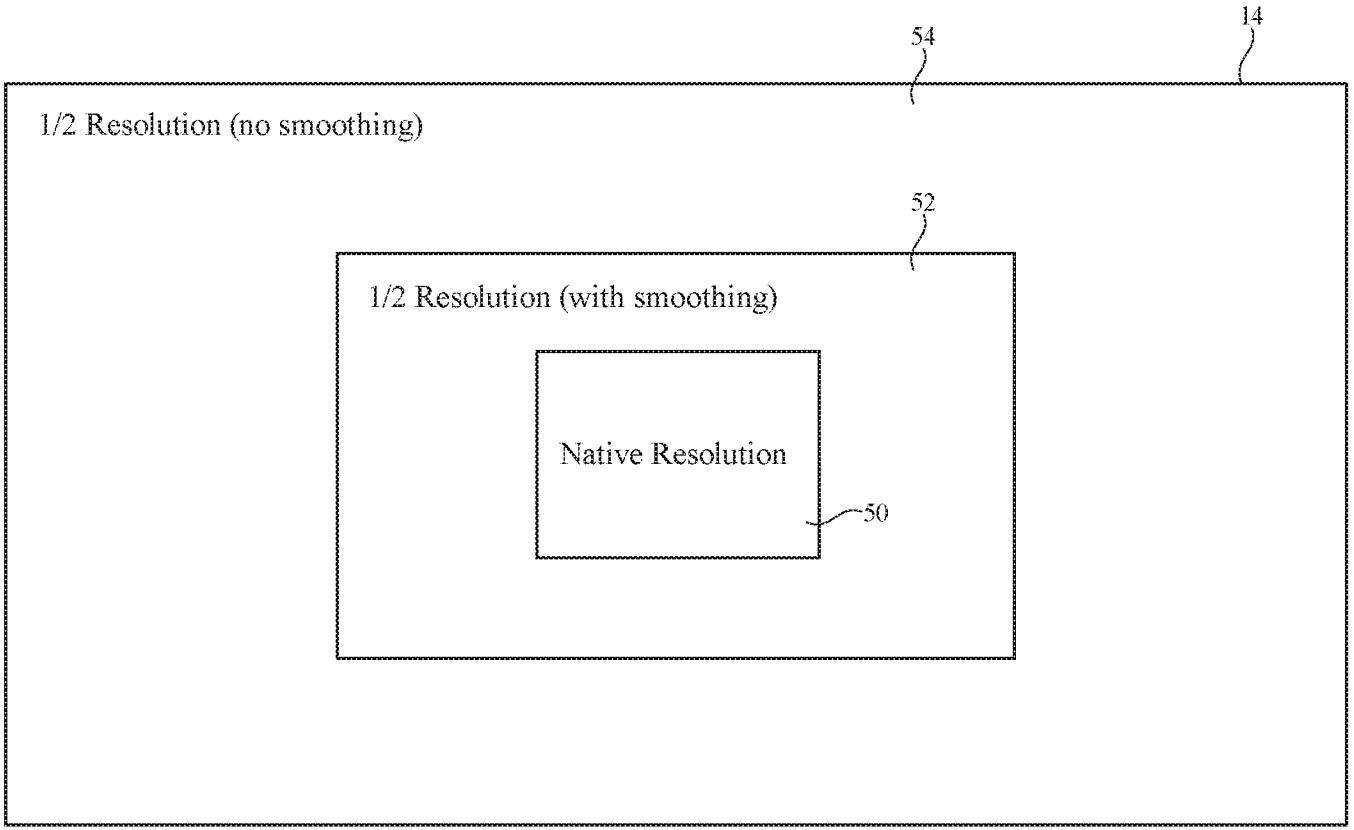
FIG. 2 is a diagram showing regions on a display with image data of different resolutions in accordance with an embodiment.

Consider, as an example, the illustrative display of FIG. 2. Using gaze tracking (e.g., using a camera in devices 12 to capture information on the location of a user's gaze on display 14), device 10 can determine which portion of display 14 is being viewed only by a user's peripheral vision and which portion of display 14 is being viewed directly (non-peripherally) by a user (e.g., in the centermost 5° of the user's field of view corresponding to the fovea of the user's eyes where visual acuity is elevated). A user will be less sensitive to artifacts and low resolution in portions of display 14 that lie within the user's peripheral vision than portions of display 14 that are being directly viewed. Accordingly, device 10 may display different portions of an image with different resolutions.

As shown in FIG. 2, a portion of display 14 that is being directly viewed by the user may be displayed using the full (native) resolution available from pixel array 24 (i.e., the full number of pixels per inch available from array 24). In the native resolution area (area 50), each pixel 26 is provided with unfiltered full resolution data. In portions of the image that lie in the user's peripheral vision such as area 52 and 54, graphics processing unit 22 can render the image with a lower resolution (e.g., with half resolution in the example of FIG. 2). In the most peripheral portions of the display (e.g., area 54), the display driver circuitry of display 14 can display the half-resolution image content without using any hardware smoothing (e.g., pixels can be filled with nearest-neighbor interpolated values using column driver circuitry 30). In intermediate locations such as inner peripheral portion 52, filtering circuitry 42 and/or 44 of FIG. 1 in the display driver circuitry can perform hardware smoothing to improve image quality beyond nearest-neighbor quality. Because the hardware smoothing takes place in the display driver circuitry, link 34 need not support as a data transmission bandwidth that is as large as would be required if smoothing operations were performed in graphics processing unit 22. Filtering circuitry 42 and/or 44 may implement box filtering (e.g., averaging each set of four neighboring pixels), bilinear interpolation filtering, Gaussian filtering, or other suitable two-dimensional spatial filtering.

Figure 3:
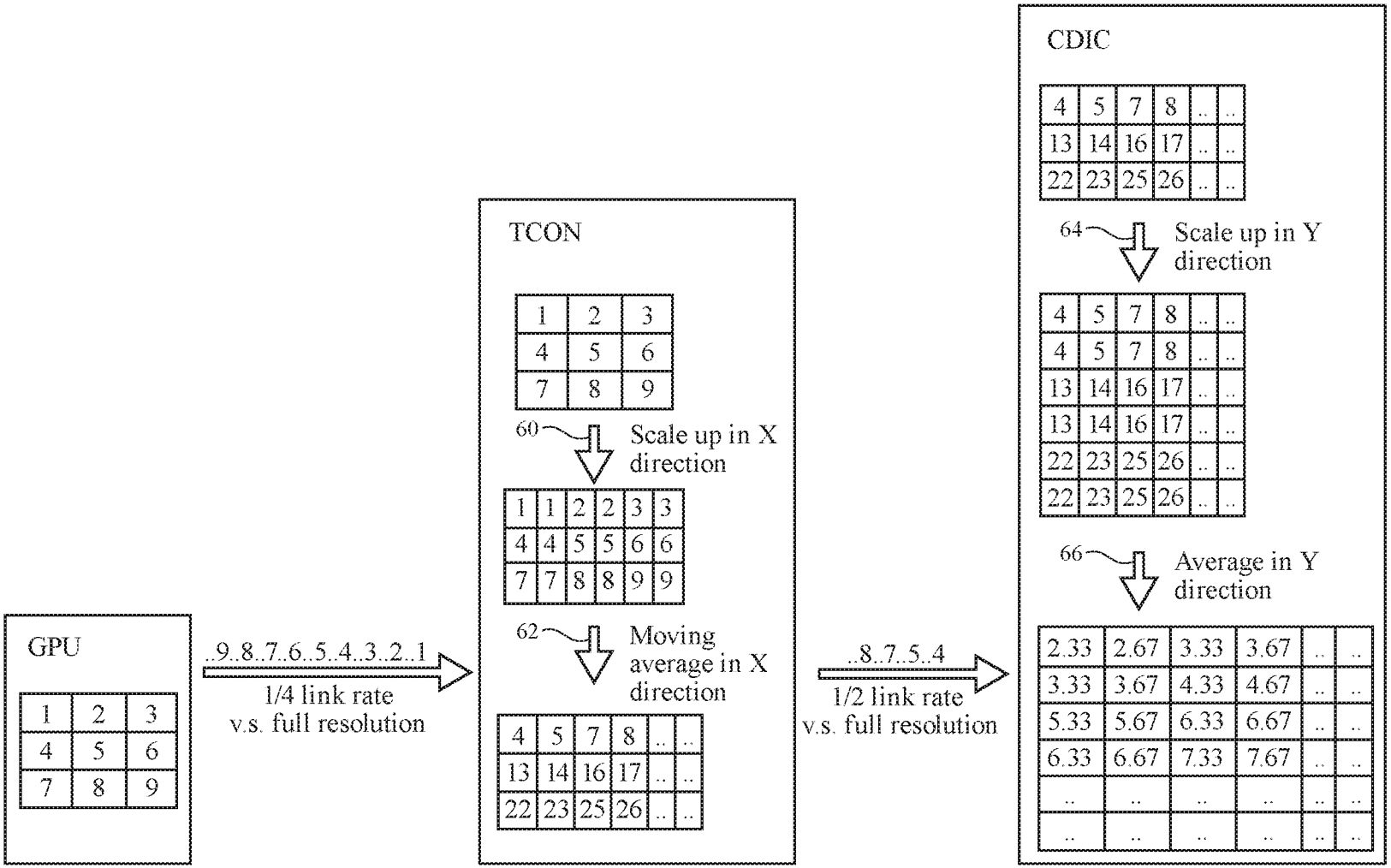
FIG. 3 is a diagram showing how interpolation and filtering operations may be applied to image data using circuitry in a timing controller integrated circuit and display driver integrated circuit in accordance with an embodiment.

An illustrative filtering arrangement is shown in FIG. 3. As shown in FIG. 3, the data rate for link 34 between graphics processing unit 22 and timing controller integrated circuit 28 may be maintained at a relatively low value (e.g., a quarter of other suitable fraction of the link rate that would be required for supporting full-frame native resolution images on display 14). Timing controller integrated circuit 28 may use filter circuitry 42 to apply a nearest neighbor interpolation process (step 60) followed by a performing a one-dimensional box filtering operation for a two-dimensional box filter or other two-dimensional spatial filter (step 62). Image data may then be conveyed from timing controller integrated circuit 28 to column driver integrated circuit 30 over link 36 at a rate that is half of the full resolution rate. In column driver integrated circuit 30, filter circuitry 44 may then perform another nearest neighbor interpolation (step 64). The interpolation operations of step 64 may take place in the orthogonal Y dimension instead of the X dimension for the operations of step 60. Following the operations of step 64, filter circuitry 44 may be used to perform a second one dimensional box filtering operation for the two-dimensional box filter or other two-dimensional spatial filter (step 66). Other types of filtering may be used if desired. The arrangement of FIG. 3 is merely illustrative.

As this example demonstrates, foveated rendering (e.g., limiting the native resolution rendering performed by graphics processing unit 22 to an area directly in a user's line of sight such as region 50 of FIG. 2) reduces rendering burdens on graphics processing unit 22 and reduces the data transfer bandwidth requirements for links such as link 34. Image quality may be improved in areas such as area 52 of the image of FIG. 2 using filtering circuit in the display driver circuitry. Filtering circuitry 42 and 44 may be implemented using digital signal processors and other image processing circuitry (as an example).

Figure 4:
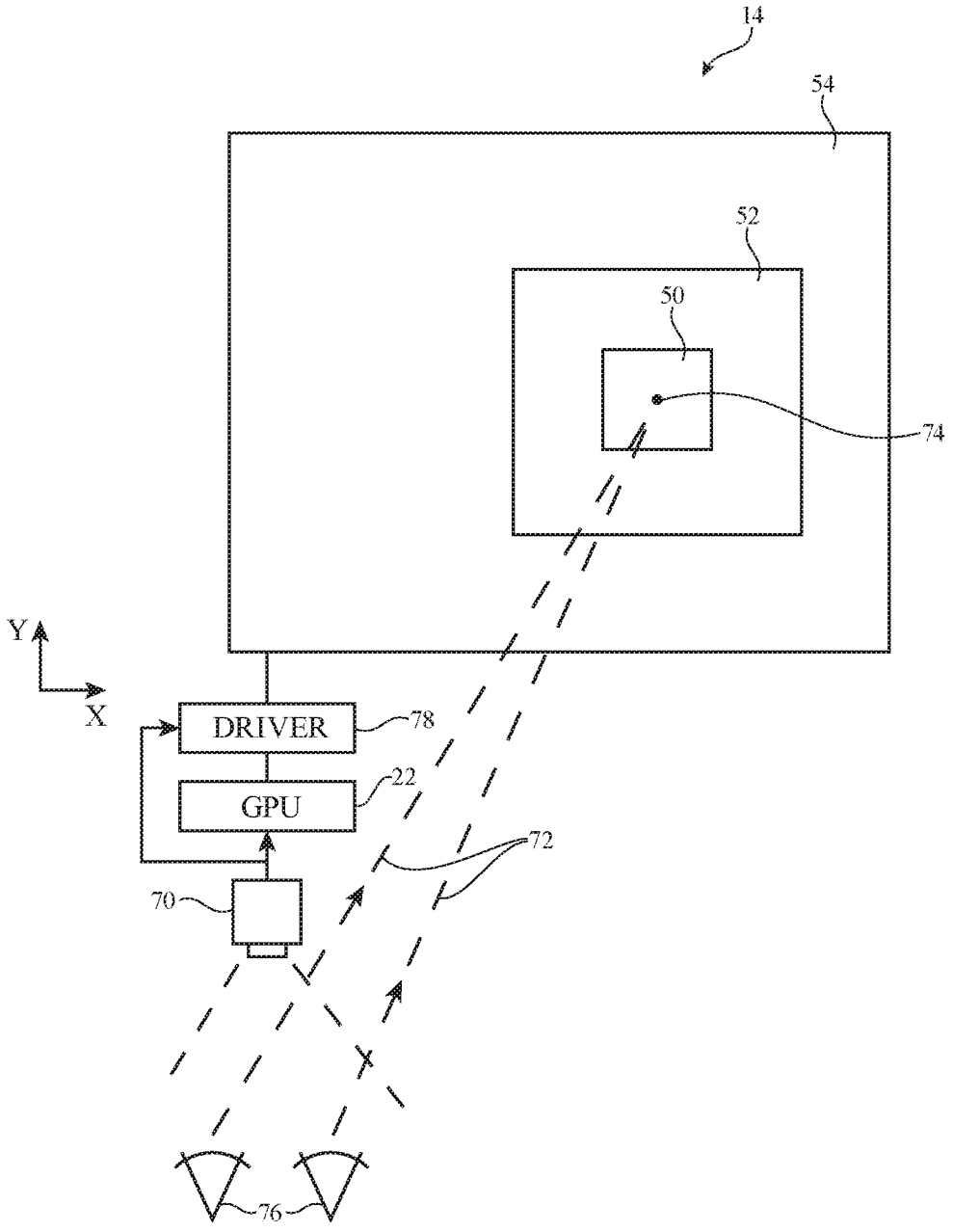
FIG. 4 is a diagram of an illustrative device having a gaze tracking system and a foveated display in accordance with an embodiment.

FIG. 4 shows how information on the direction of a user's gaze on display 14 (i.e., gaze location on display 14) may be used to control where high resolution portions of an image are displayed on the display. In the example of FIG. 4, device 10 has a gaze detection system with a camera such as camera 70. Camera 70 may capture images of a user's eyes such eyes 76 and can process the captured images to determine where a user is gazing. In the example of FIG. 4, a viewer is looking in direction 72 at gaze location 74 on display 14. Gaze location information may be supplied from the gaze detection system to graphics processing unit 22 and/or display driver circuitry 78. Some or all of the display driver circuitry may be integrated into display 14. Configurations in which one or more additional integrated circuits are used in processing image data from graphics processing unit 22 may also be used (e.g., configurations in which image processing circuits are interposed between graphics processing unit 22 and display driver circuitry 78).

Display 14 may be used in an augmented reality or virtual reality environment. As a result, it may be desirable for display 14 to be able to cover a wide field of view (e.g., 145°) and exhibit low latency (e.g., less than 5 ms or other suitable amount). With one illustrative arrangement, display 14 of FIG. 4 may be a sequential color display such as a display based on a liquid-crystal-on-silicon chip (silicon die). In this type of display, sequential image frames are associated with different colors. The desire to display frames in colors (e.g., three colors) and the desired for the display to exhibit low latency (e.g., to use a frame refresh rate of 240 Hz) while supporting high resolution poses challenges. If care is not taken, very large data transmission bandwidths may be involved. Using foveation techniques, only a portion of the displayed image such as portion 50 surrounding gaze location 74 will be displayed at high resolution, whereas portions of display 14 in the user's peripheral vision such as portion 54 will be displayed at lower resolution. Intermediate portions of display 14 such as portion 52 adjacent to high resolution portion 50 may be displayed with intermediate resolution.

During operation, the location of the user's gaze (location 74) may be tracked dynamically using eye tracking (e.g., gaze detection system 70). The highest acuity area of a human eye may span about 5 degrees, whereas the field of view encompassed by display 14 may be 145°. Based on gaze location information, device 10 can update the location of region 50 dynamically.

Consider, as an example, a scenario in which display 14 displays images in regions with two different resolutions (rather than the illustrative three different resolutions of FIG. 4). In this type of scenario, intermediate resolution area 52 may be omitted. In region 50, images may be displayed at high resolution (e.g., at an 8k×8k resolution). In region 54, the number of unique pixels per inch may be reduced by a factor of 8 in both X and Y dimensions. With this arrangement, image content may be displayed at a 1k×1k resolution in region 54.

Display 14 may include frame buffer circuitry. With one illustrative configuration, the display driver circuitry for display 14 includes a single 8k×8k frame buffer and only a subset of the frame buffer (corresponding to high resolution area 50) is be updated with high resolution data from graphics processing unit 22. The entire frame buffer can be read into the display at 720 Hz (e.g., for a color sequential display). This would reduce data bandwidth from graphics processing unit 22 by a factor of 64.

With another illustrative configuration, display 14 has multiple frame buffers. This may reduce the amount of circuit resources needed for buffering. The multiple frame buffers (or frame buffer regions) of display 14 may each be associated with a different resolution. For example, the display driver circuitry may include two 1k×1k frame buffers. A low resolution frame buffer (LRFB) may be used to buffer data for low resolution area 54 of display 14 and a high resolution frame buffer (HRFB) may be used to buffer data for high resolution area 50 of display 14. This approach may be used to reduce both data bandwidth from graphics processing unit 22 and frame buffer area.

Figure 5:
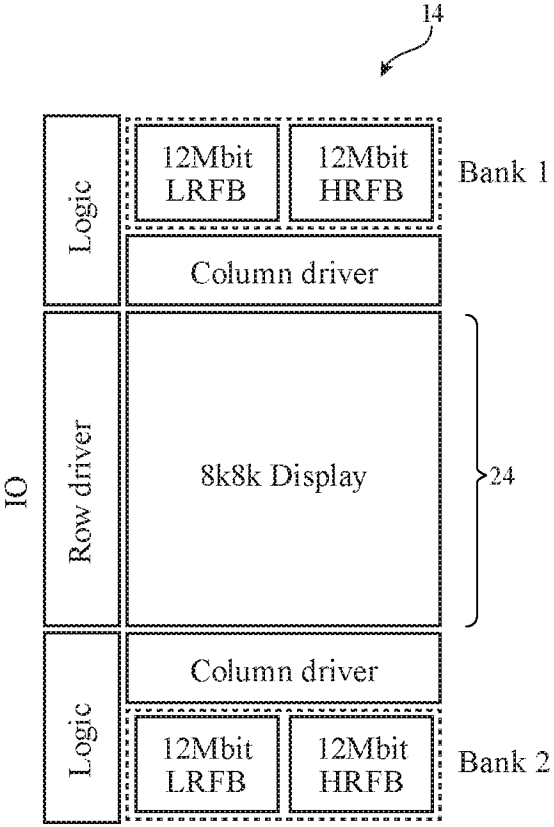
FIG. 5 is a diagram of an illustrative display such as a liquid-crystal-on-silicon display formed on a liquid-crystal-on-silicon substrate and having low and high resolution image data buffers in accordance with an embodiment.

A diagram of an illustrative display (e.g., a liquid crystal on silicon display or other display) that includes multiple frame buffers is shown in FIG. 5. The circuitry of FIG. 5 may be implemented on a single silicon integrated circuit and/or may be implemented using multiple integrated circuits or other arrangements. Pixel array 24 of display 14 of FIG. 5 may have pixels with a relatively high resolution (e.g., 8k), if desired. Display driver circuitry such as column driver circuitry, row driver circuitry, control logic, input-output circuitry, low resolution frame buffers LRFB and high resolution frame buffers HRFB may be provided in multiple banks (e.g., bank1 and bank2). This allows one set of column drivers, buffers, and associated circuitry to be provided with data for an upcoming image frame while another set of column drivers, buffers, and associated circuitry is being used in loading data into pixel array 24.

With a configuration of the type shown in FIG. 5, graphics processing unit 22 provides display 14 with low resolution data corresponding to the full size of pixel array 24 (area 54 of FIG. 4) for storing in low resolution buffer circuitry LRFB while providing display 14 with high resolution data for region 50 (FIG. 4) that is stored in high resolution buffer circuitry HRFB. The logic circuitry of FIG. 5 may implement a finite state machine that handles functions such as decompressing received data, controlling the row driver (gate driver) circuitry, determining how to load data into each frame buffer and how to display appropriate data from the low and high resolution frame buffers on pixel array 24 to create an image with a low resolution portion such as portion 54 of FIG. 4 and a high resolution portion at gaze location 74 such as high resolution portion 50 of FIG. 4.

Figure 6:
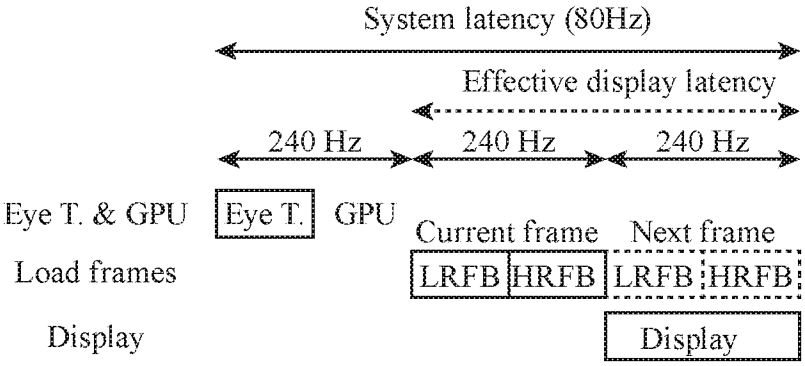
FIGS. 6 and 7 are timing diagrams showing how image data may be displayed on a display of the type shown in FIG. 5 in accordance with an embodiment.
Figure 7:
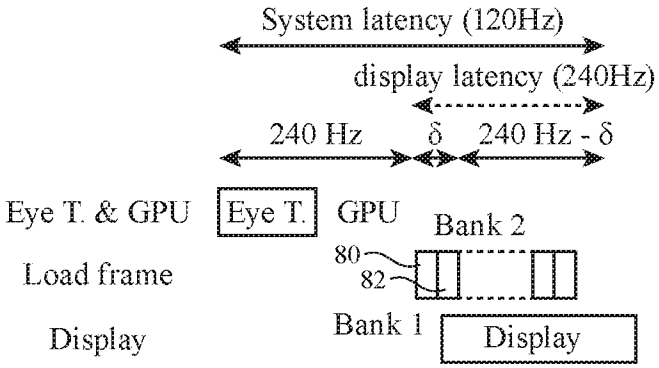

Display 14 may be driven using a dual frame architecture or an interleaved architecture. System latency is affected by the time consumed by eye tracking and by graphics processing unit operations. System latency is also affected by the time consumed with loading image data (e.g., data for the current and next frames). A timing diagram showing how display 14 may be operated using an illustrative dual frame architecture is shown in FIG. 6. As shown in FIG. 6, each buffer (LRFB and HRFB) is loaded sequentially for the current and next frame. A timing diagram showing how display 14 may be operated using an illustrative interleaved architecture is shown in FIG. 7. As shown in FIG. 7, latency may be reduced by loading the low and high resolution buffers in interleaved portions (i.e., alternating low and high resolution rows or other slices of data from graphics processing unit 22), as illustrate by interleaved slices 80 and 82 of FIG. 7.

Figure 9:
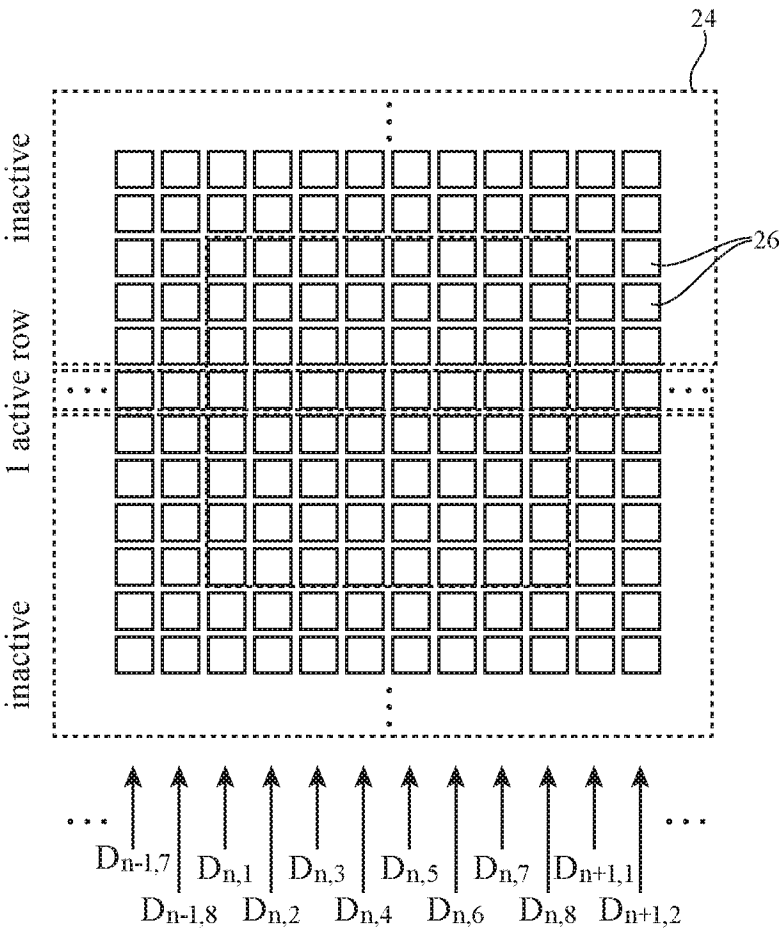
FIGS. 8 and 9 show how display driver circuitry may drive signals onto different numbers of gate lines and data lines to accommodate loading of image data of different resolutions in accordance with an embodiment.
Figure 8:
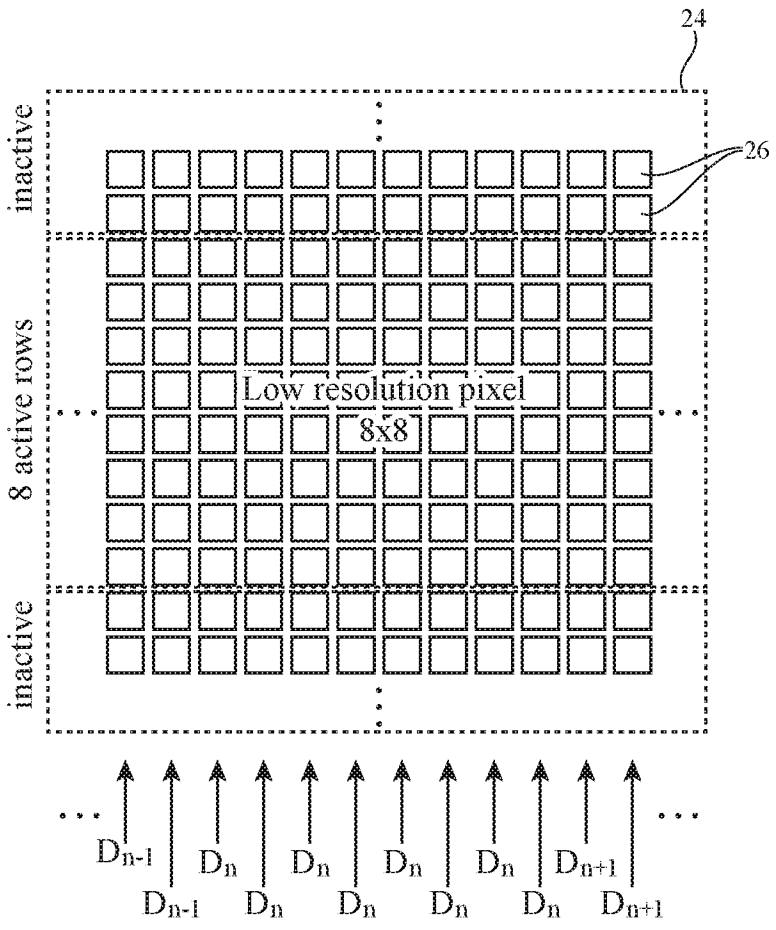

FIGS. 8 and 9 show how pixels 26 in pixel array 24 may be loaded with low or high resolution data. In the example of FIG. 8, data is being loaded into array 24 with a low resolution. In this scenario, each 8 rows of array 24 are loaded with the same data (see, e.g., the "8 active rows" of array 24 that are being loaded in the example of FIG. 8) and each 8 columns of array 24 are located with the same data (see, the centermost 8 columns of array 24, which are all receiving the same data signal Dn). In the example of FIG. 9, individual data Dn,1, Dn,2, Dn,3 . . . is being loaded into each of the columns for a given row ("1 active row"). The resolution of the image loaded into array 24 of FIG. 8 is therefore 8 times lower in both the horizontal and vertical dimensions than the resolution of the image loaded into array 24 of FIG. 9. With this type of arrangement, low resolution portion 54 of display 14 will have low resolution "pixels" each of which is made up of 64 pixels loaded with the same data. Other ratios of high to low resolution may be used, if desired. The configuration of FIGS. 8 and 9 is merely illustrative.

Illustrative gate driver circuitry 32 that can be selectively configured to load data with different resolutions is shown in FIG. 10. Gate driver circuitry 32 of FIG. 10 may be configured to assert an individual gate line signal on the gate line (row line) in each row of array 24 (e.g., when the selection signals that configure circuitry 32 place circuitry 32 in the scan by one mode of FIG. 11), may be configured to assert the same gate line signal on each pair of adjacent gate lines in array 24 (e.g., when the selection signals that configure circuitry 32 place circuitry 32 in the scan by two mode of FIG. 12), to may be configured to assert the same gate line signal on each set of four adjacent gate line in array 24 (e.g., when the selection signals that configure circuitry 32 place circuitry 32 in the scan by four mode of FIG. 13), and may be configured to assert the same gate line signal on each set of 8 adjacent gate lines in array 24 (e.g., when the selection signals that configure circuitry 32 place circuitry 32 in the scan by eight mode of FIG. 12). The "by 1" mode of FIG. 11 may be used to load data with the highest resolution (e.g., the highest row resolution) and the "by 8" mode of FIG. 14 and the "by 2" and "by 4" modes may be used to load data with lower resolutions. Additional gate line driving modes to support image data loading with different resolutions may be used, if desired.

Figure 15:
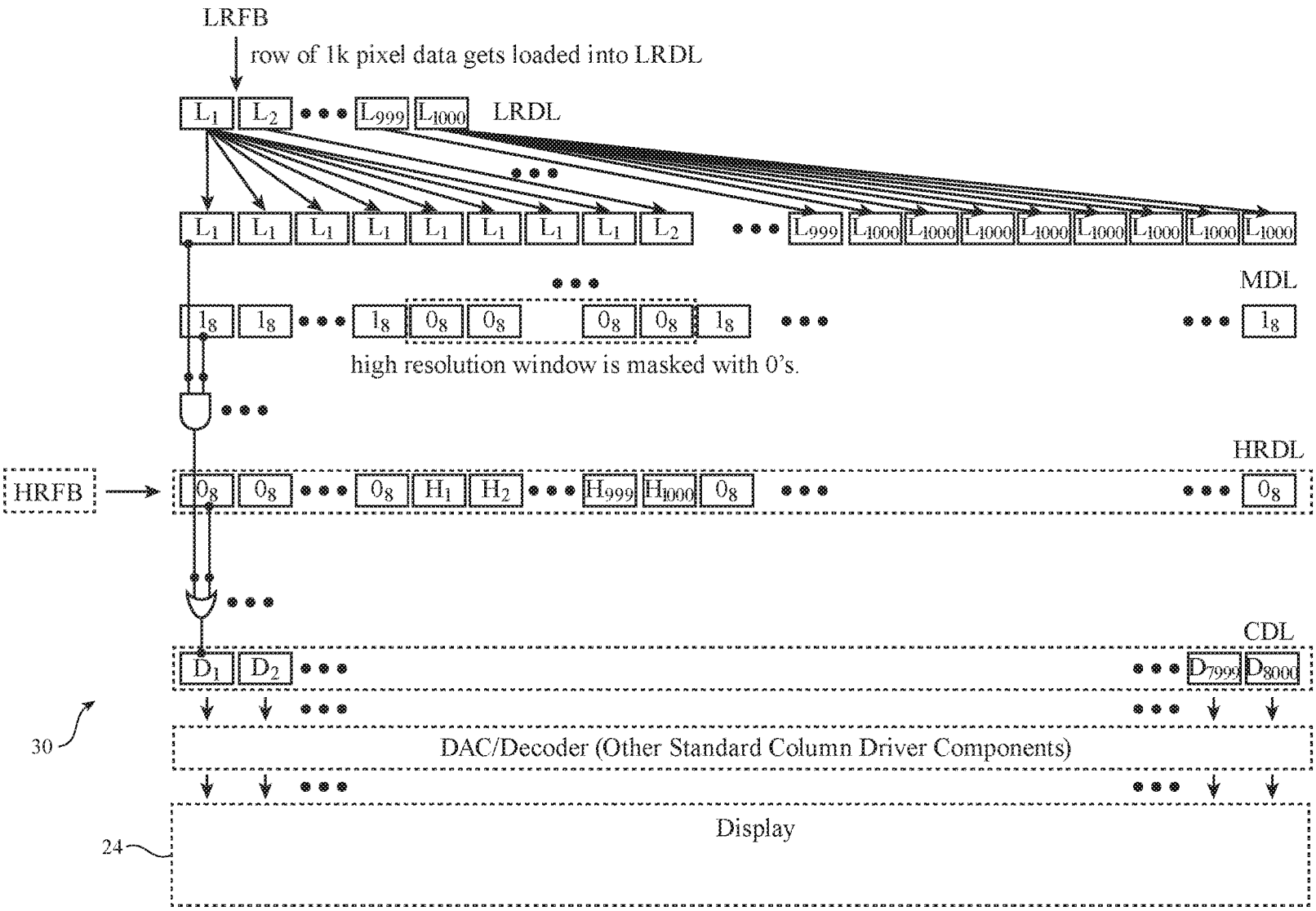
FIG. 15 is a diagram of illustrative display driver circuitry such as column driver circuitry that may be used to load data of different resolutions into different areas of a display in accordance with an embodiment.

FIG. 15 shows how display driver circuitry 30 (see, e.g., the display driver circuitry of FIG. 5) can be configured to load different numbers of columns at a time. Rows of column data may be located into latches. For example, low resolution data from low resolution frame buffer LRFB may be loaded into low resolution data latch LRDL. High resolution data from high resolution frame buffer HRFB may be loaded into high resolution data latch HRDL. A combination of the high and low resolution data may then be loaded into a row of pixels 26 in pixel array 24.

As shown in FIG. 15, before loading data into pixels 26, the data from low resolution data latch LRDL may be expanded (e.g., by 8 times) to cover the full width of pixel array 24. Mask data latch MDL may be loaded with ones in low resolution areas of the current row and zeros in the high resolution area of the current row (i.e., a high resolution window may be masked with zeros). The high resolution data that is loaded from the high resolution frame buffer into the high resolution data latch may be shifted to the high resolution window position. If there is no high resolution data in a given row, the high resolution data latch will be filled with zeros.

A bitwise AND operation may be performed between the mask data latch and the expanded low resolution data latch. A bitwise OR operation may then be performed on the output of the AND gates and the high resolution data latch. The output of the OR gates in the display driver circuitry may be loaded into column data latch CDL. This loaded digital image data may then be converted to analog data (analog data signals D) and loaded into the current row of pixels 26 of pixel array 24 by digital-to-analog converter circuitry.

The functions of FIG. 15 may be performed by display driver circuitry in display 14, using circuitry on a separate integrated circuit, and/or using other suitable control circuitry in device 10.

Display 14 may allow data to be updated in blocks. Display 14 may, for example, be an organic light-emitting diode display, a display having an array of light-emitting diodes formed from crystalline semiconductor die, or other display that has pixels 26 with block enable circuitry to enable the pixels in a block to be loaded together.

Figure 18:
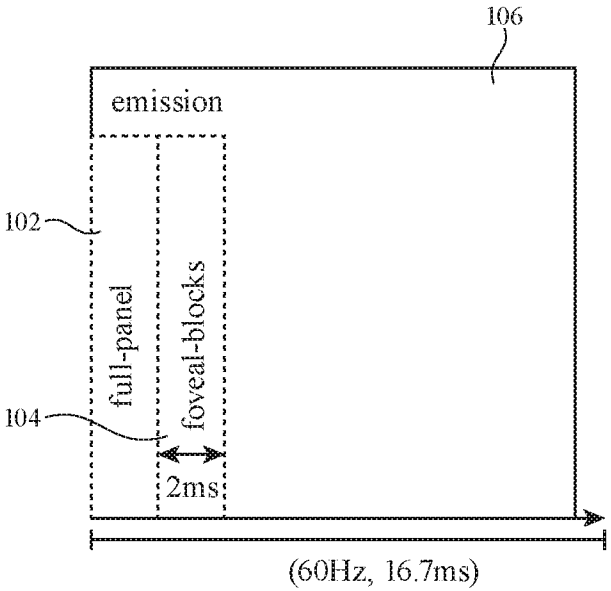
FIGS. 18, 19, 20, and 21 are illustrative data loading techniques for supplying a display with data in accordance with an embodiment.

Consider, as an example, display 14 of FIG. 18. Each pixel 26 in the pixel array of display 14 may include a block enable transistor 92 having a first source-drain terminal coupled to a data line and a second source-drain terminal coupled pixel circuitry in that pixel 26. The pixel circuitry of each pixel 26 may include a switching transistor such as switching transistor 90 and other pixel circuitry 94 (e.g., light-emitting diodes, storage capacitors, emission enable transistors, additional switching transistor, etc.). Each switching transistor 90 may have a first source-drain terminal coupled to the second source-drain terminal of block enable transistor 92 and a second source-drain terminal coupled to additional pixel circuitry 94. The gate of each switching transistor 90 may be coupled to a respective gate line G. The gate of each block enable transistor 92 may be coupled to a respective block enable line.

Figure 16:
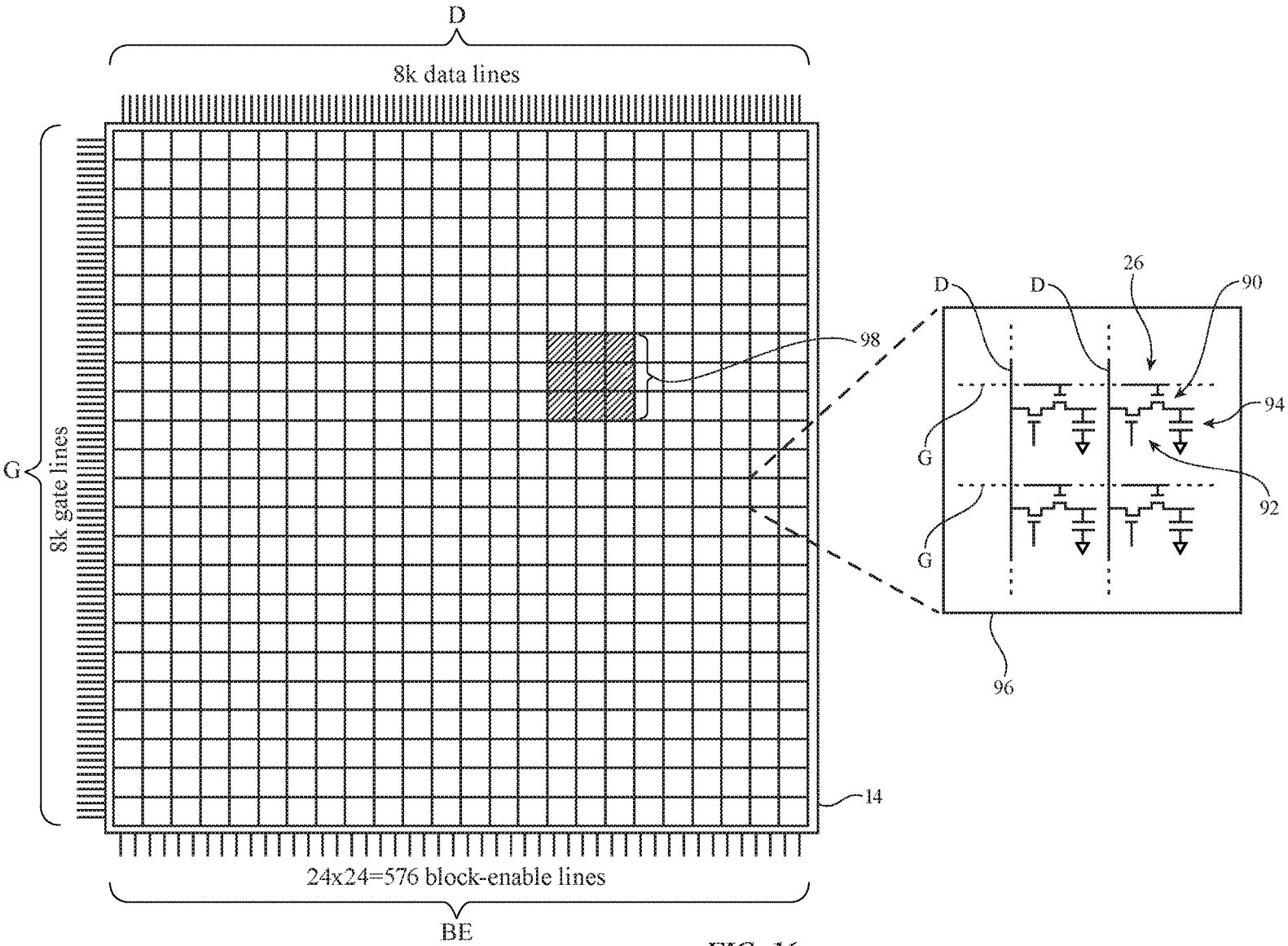
FIG. 16 is a diagram of an illustrative pixel array having pixels with block enable transistors in accordance with an embodiment.

Pixels 26 may be grouped in blocks 96 of adjacent pixels 26 (e.g., blocks of n×n pixels, where n is 2-500, 200-400, 100-500, more than 200, less than 600, or other suitable number). Sets of blocks (e.g., sets of 2-25 blocks, sets that each contain 4-9 blocks, more than 2 blocks, or fewer than 50 blocks) or individual blocks may be supplied with high resolution data while remaining blocks 96 are supplied with low resolution data. In the example of FIG. 16, a 3×3 set of blocks (block group 98) is being provided with high resolution data based on eye tracking information (e.g., based on the measured location of a user's gaze, which is overlapped by group 98). During high resolution data loading, the block enable transistors of blocks 96 in group 98 may be turned on to allow high resolution data to follow into the pixels of group 98 via data lines while the block enable transistors of other pixels 26 (pixels in blocks other than the blocks of group 98) are turned off to prevent disruption to the data in those pixels.

Figure 17:
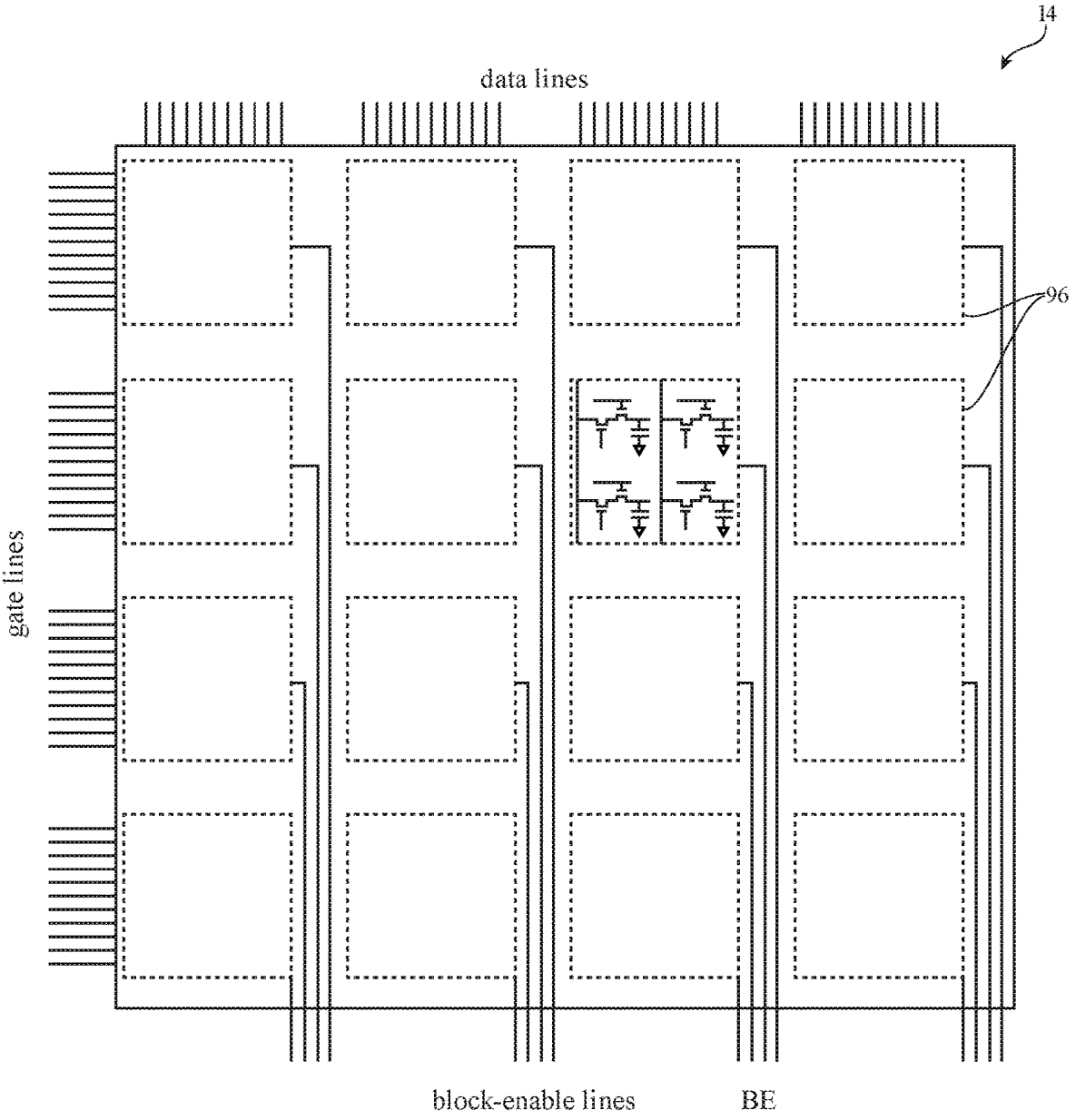
FIG. 17 is a diagram showing how blocks of pixels can be selectively enabled and disabled for data loading using corresponding block enable lines in accordance with an embodiment.

FIG. 17 shows how blocks 96 of pixels 26 may be supplied with independently adjustable block enable lines. Display driver circuitry in display 14 may control the block enable signals on lines BE to enable data loading into a desired group of blocks 96.

Blocks of pixels 26 can be updated relatively quickly and can support fast frame rates. Undesirable visible artifacts such as motion blur effects can be minimized by driving pixels 26 with a low duty cycle (e.g., 2 ms) and high frame rate (e.g., 90 Hz). Block-wise refreshing schemes may support this type of operation. The inclusion of block enable transistors into pixels 26 may also allow for selective high frame rate updating. For example, the entire video bandwidth of display 14 may be temporarily dedicated to refreshing pixel array 24 at low resolution whenever gaze detection system 70 detects that a user's gaze is rapidly changing (e.g., by disabling high resolution loading). As another example, display 14 may be configured to produce multiple light fields each associated with a different respective focal plane. This may be accomplished using multiple stacked transparent displays at different distances from a user's eyes, using tunable lenses that tune to different focal lengths at different times (when different image data is being displayed), using electrically adjustable beam steering equipment in combination with diffractive optics, etc. In a depth-fused multi-focal-plane display, peripheral blocks 96 may be refreshed with a relatively low rate when a user's gaze is steady while foveal blocks (blocks in the user's direct line of sight) can be refreshed at higher frequencies (e.g., in synchronization with lens tuning changes in a tunable lens system).

FIGS. 18, 19, 20, and 21 illustrate how display 14 may be refreshed under different operating conditions.

In FIG. 18, display 14 is being operated in a normal display mode. Data is written into the entire pixel array 24 at low resolution during period 100 and foveal blocks 96 are written with data during period 102. Pixels 26 of display 14 emit light for producing an image for a viewer during emission period (frame duration) 106.

Figure 19:
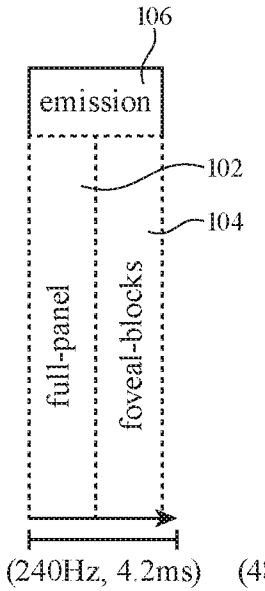

In FIG. 19, display 14 is being refreshed in a high-frame rate mode. In this configuration, writing periods 102 and 104 may be performed repeatedly (i.e., back-to-back) and frame duration may be reduced.

Figure 20:
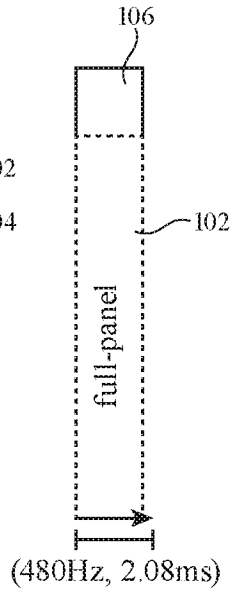

FIG. 20 shows how ultrahigh frame rates may be achieved (e.g., to accommodate rapid eye movements) by temporarily refreshing pixel array 24 at low resolution only.

Figure 21:
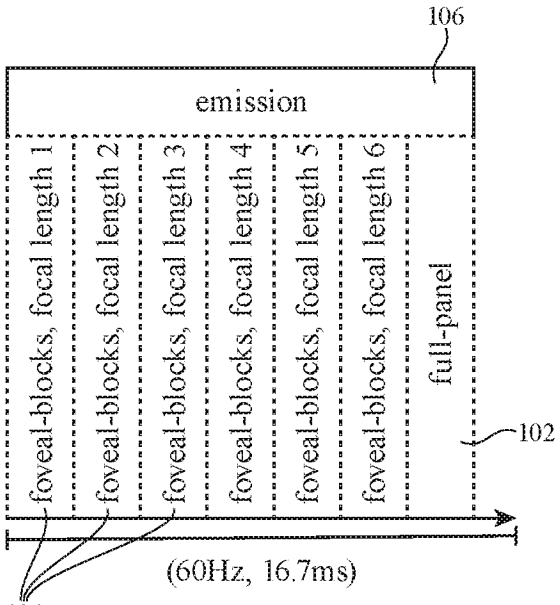

FIG. 21 shows how during each frame multiple foveal refresh operations (periods 104) may be performed repeatedly (e.g., during synchronized tunable lens adjustments in a multi-focal-plane display) and only a single full display low resolution refresh operation may be performed (period 102).

In accordance with an embodiment, an electronic device is provided that includes a graphics processing unit that supplies image data with a first resolution and image data with a second resolution that is higher than the first resolution, and a display includes a pixel array having rows and columns of pixels, data lines associated with the columns of pixels, gate lines associated with the rows of pixels, gate line driver circuitry coupled to the gate lines, a timing controller integrated circuit that receives the image data from the graphics processing unit, and a column driver integrated circuit that receives the image data from the timing controller integrated circuit and that loads the image data into the pixel array, at least one of the timing controller integrated circuit and the column driver integrated circuit includes interpolation and filter circuitry that performs interpolation and filtering on the image data with the first resolution.

In accordance with another embodiment, the interpolation and filter circuitry forms part of the timing controller integrated circuit and is configured to perform a nearest neighbor interpolation on the image data of the first resolution.

In accordance with another embodiment, the interpolation and filter circuitry forms part of the column driver integrated circuit and is configured to perform a nearest neighbor interpolation on the image data of the first resolution.

In accordance with another embodiment, the interpolation and filter circuitry forms part of the timing controller integrated circuit and is configured to perform box filtering on the image data of the first resolution.

In accordance with another embodiment, the interpolation and filter circuitry forms part of the column driver integrated circuit and is configured to perform box filtering on the image data of the first resolution.

In accordance with another embodiment, the interpolation and filtering circuitry includes a first interpolation and filtering circuit in the timing controller integrated circuit, and a second interpolation and filtering circuit in the column driver integrated circuit.

In accordance with another embodiment, the first interpolation and filtering circuit is configured to perform nearest neighbor interpolation on the image data of the first resolution for a first dimension of the pixel array and the second interpolation and filtering circuit is configured to perform nearest neighbor interpolation on the image data of the first resolution for a second dimension of the pixel array that is orthogonal to the first dimension.

In accordance with another embodiment, the first interpolation and filtering circuit is configured to perform box filtering on the image data of the first resolution and the second interpolation and filtering circuit is configured to perform box filtering on the image data of the first resolution.

In accordance with another embodiment, the first interpolation and filtering circuit is configured to perform a first one-dimensional spatial filtering operation for a two-dimensional spatial filter to the image data of the first resolution and the second interpolation and filtering circuit is configured to perform a second one-dimensional spatial filtering operation for the two-dimensional spatial filter to the image data of the first resolution.

In accordance with another embodiment, the first and second interpolation and filtering circuits are further configured to perform nearest neighbor interpolation operations on the image data of the first resolution.

In accordance with another embodiment, the electronic device includes a gaze tracking system that supplies information on a gaze location and the graphics processing unit is configured to produce the image data with the second resolution for a portion of the pixel array that overlaps the gaze location.

In accordance with another embodiment, the first and second interpolation and filtering circuits are configured to perform filtering on the image data with the first resolution without performing filtering on the image data with the second resolution.

In accordance with an embodiment, an electronic device is provided that includes an array of pixels, a gaze detection system that is configured to supply information on a gaze location, a graphics processing unit configured to provide image data for the array of pixels at a first resolution and that is configured to provide image data for a portion of the array of pixels that overlaps the gaze location at a second resolution that is higher than the first resolution, at least first and second frame buffers, the first frame buffer is configured to receive the image data from the graphics processing unit at the first resolution and the second frame buffer is configured to receive the image data from the graphics processing unit at the second resolution, and circuitry configured to load the image data with the first resolution into the array of pixels from the first frame buffer and that is configured to load the image data with the second resolution into the portion of the array of pixels that overlaps the gaze location from the second frame buffer.

In accordance with another embodiment, the array of pixels and the first and second frame buffers are formed on a liquid-crystal-on-silicon display.

In accordance with another embodiment, the circuitry that is configured to load the image data includes row driver circuitry that is configured to, assert signals on gate lines individually for portions of the pixel array that include the portion of the array of pixels that overlaps the gaze location, and assert a common gate line signal on a set of multiple adjacent gate lines in rows of the pixel array that do not include the portion of the array of pixels that overlaps the gaze location.

In accordance with another embodiment, the circuitry that is configured to load the image data includes column driver circuitry that includes a first latch configured to receive the image data with the first resolution and includes a second latch configured to receive the image data with the second resolution.

In accordance with an embodiment, an electronic device is provided that includes a pixel array having rows and columns of pixels, data lines associated with the columns of pixels. gate lines associated with the rows of pixels, display driver circuitry coupled to the data lines and gates lines, each pixel in the array of pixels has a pixel circuit with a switching transistor and has a block enable transistor coupled to the switching transistor, and a gaze detection system that is configured to supply information on a gaze location, the display driver circuitry is configured to turn on the block enable transistors in at least one block of the pixels based on the gaze location.

In accordance with another embodiment, each block enable transistor has a source-drain terminal coupled to a respective one of the data lines and has a gate controlled by a block enable line.

In accordance with another embodiment, the display driver circuitry is configured to turn on the block enable transistors in a set of the blocks based on the gaze location.

In accordance with another embodiment, the display driver circuitry is configured to receive image data with a first resolution, receive image data with a second resolution that is higher than the first resolution, load the image data with the second resolution into the set of blocks and load the image data with the first resolution into blocks in the array of pixel circuitry other than the set of blocks.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a graphics processing unit that supplies image data with a first resolution and image data with a second resolution that is higher than the first resolution;

a display, comprising:

a pixel array having rows and columns of pixels;

data lines associated with the columns of pixels;

gate lines associated with the rows of pixels;

gate line driver circuitry coupled to the gate lines;

a timing controller integrated circuit that receives the image data from the graphics processing unit; and a column driver integrated circuit that receives the image data from the timing controller integrated circuit and that loads the image data into the pixel array, wherein at least one of the timing controller integrated circuit and the column driver integrated circuit includes interpolation and filter circuitry that performs interpolation and filtering on the image data with the first resolution, and wherein the interpolation and filtering circuitry comprises:

a first interpolation and filtering circuit in the timing controller integrated circuit configured to perform a first operation for a first dimension of the pixel array; and a second interpolation and filtering circuit in the column driver integrated circuit configured to perform a second operation different than the first operation for a second dimension of the pixel array that is orthogonal to the first dimension; and a gaze tracking system that supplies information on a gaze location, wherein the graphics processing unit is configured to produce the image data with the second resolution for a portion of the pixel array that overlaps the gaze location.

2. The electronic device defined in claim 1 wherein the first interpolation and filtering circuit is configured to perform a nearest neighbor interpolation on the image data of the first resolution.

3. The electronic device defined in claim 1 wherein the second interpolation and filtering circuit is configured to perform a nearest neighbor interpolation on the image data of the first resolution.

4. The electronic device defined in claim 1 wherein the first interpolation and filtering circuit is configured to perform box filtering on the image data of the first resolution.

5. The electronic device defined in claim 1 wherein the second interpolation and filtering circuit is configured to perform box filtering on the image data of the first resolution.

6. The electronic device defined in claim 1 wherein the first interpolation and filtering circuit is configured to perform a first one-dimensional spatial filtering operation for a two-dimensional spatial filter to the image data of the first resolution and wherein the second interpolation and filtering circuit is configured to perform a second one-dimensional spatial filtering operation for the two-dimensional spatial filter to the image data of the first resolution.

7. The electronic device defined in claim 6 wherein the first and second interpolation and filtering circuits are further configured to perform nearest neighbor interpolation operations on the image data of the first resolution.

8. The electronic device defined in claim 1 wherein the first and second interpolation and filtering circuits are configured to perform filtering on the image data with the first resolution without performing filtering on the image data with the second resolution.

9. An electronic device, comprising:

an array of pixels;

a gaze detection system that is configured to supply information on a gaze location;

a graphics processing unit configured to provide image data for the array of pixels at a first resolution and that is configured to provide image data for a portion of the array of pixels that overlaps the gaze location at a second resolution that is higher than the first resolution;

at least first and second frame buffers, wherein the first frame buffer is configured to receive the image data from the graphics processing unit at only the first resolution and wherein the second frame buffer is configured to receive the image data from the graphics processing unit at only the second resolution;

a first data latch configured to receive the image data from the first frame buffer;

a second data latch configured to store bits for masking the image data received at the first data latch; and circuitry configured to load the masked image data into the array of pixels and to load the image data with the second resolution into the portion of the array of pixels that overlaps the gaze location from the second frame buffer.

10. The electronic device defined in claim 9 wherein the array of pixels and the first and second frame buffers are formed on a liquid-crystal-on-silicon display.

11. The electronic device defined in claim 9 wherein the circuitry that is configured to load the image data comprises row driver circuitry that is configured to:

assert signals on gate lines individually for portions of the array of pixels that include the portion of the array of pixels that overlaps the gaze location; and assert a common gate line signal on a set of multiple adjacent gate lines in rows of the array of pixels that do not include the portion of the array of pixels that overlaps the gaze location.

12. The electronic device defined in claim 9, further comprising:

a third data latch configured to receive the image data from the second frame buffer; and a first plurality of logic gates having inputs coupled to the first data latch and to the second data latch;

a second plurality of logic gates having inputs coupled to the first plurality of logic gates and to the third data latch; and a column data latch configured to receive signals from the second plurality of logic gates.

13. An electronic device, comprising:

a pixel array having rows and columns of pixels;

data lines associated with the columns of pixels;

gate lines associated with the rows of pixels;

block enable lines associated with blocks of pixels in the array;

display driver circuitry coupled to the data lines and gates lines, wherein each pixel in the array of pixels comprises:

a pixel circuit with a switching transistor having a gate coupled to one of the gate lines; and a block enable transistor coupled to the switching transistor and having a gate coupled to one of the block enable lines; and a gaze detection system that is configured to supply information on a gaze location, wherein the display driver circuitry is configured to turn on the block enable transistors in at least one block of the pixels based on the gaze location.

14. The electronic device defined in claim 13 wherein each block enable transistor has a source-drain terminal coupled to a respective one of the data lines.

15. The electronic device defined in claim 14 wherein the display driver circuitry is configured to turn on the block enable transistors in a set of the blocks based on the gaze location.

16. The electronic device defined in claim 15 wherein the display driver circuitry is configured to:

receive image data with a first resolution;

receive image data with a second resolution that is higher than the first resolution;

load the image data with the second resolution into the set of blocks; and load the image data with the first resolution into blocks in the array of pixel circuitry other than the set of blocks.

* * * * *